US005494363A

United States Patent [19]

Hochgesang

[11] Patent Number: 5,494,363

[45] Date of Patent: Feb. 27, 1996

[54] KEYBOARD

[75] Inventor: Gerhard Hochgesang, Lebenhan, Germany

[73] Assignee: Preh-Werke GmbH Co. KG, Bad Neustadt, Germany

[21] Appl. No.: 207,076

[22] Filed: Mar. 8, 1994

[30] Foreign Application Priority Data

Mar. 16, 1993 [DE] Germany ..... 9303837 U

[51] Int. Cl.[6] ..... B41J 5/16

[52] U.S. Cl. ..... 400/495; 400/472; 400/490; 200/5 A

[58] Field of Search ..... 400/472, 490, 400/491, 491.1, 495, 473; 200/512, 513, 341, 345, 275, 5 A

[56] References Cited

U.S. PATENT DOCUMENTS

| | | | |
|---|---|---|---|
| 4,499,343 | 2/1985 | Prioux et al. | 200/5 A |
| 4,518,833 | 5/1985 | Watkins | 200/5 A |
| 4,524,249 | 6/1985 | Farrell | 200/5 A |
| 4,531,033 | 7/1985 | Schmid et al. | 200/314 |
| 4,649,246 | 3/1987 | Schmid et al. | 200/5 A |
| 4,820,908 | 4/1989 | Wei | 200/5 A |
| 4,902,862 | 2/1990 | Oelsch et al. . | |
| 5,172,990 | 12/1992 | Weng | 400/490 |
| 5,212,356 | 5/1993 | English | 200/513 |

FOREIGN PATENT DOCUMENTS

| | | |
|---|---|---|
| 0087369B1 | 8/1983 | European Pat. Off. . |
| 0094839A1 | 11/1983 | European Pat. Off. . |
| 0305931A2 | 3/1989 | European Pat. Off. . |
| 0398186A2 | 11/1990 | European Pat. Off. . |
| 0453274A2 | 10/1991 | European Pat. Off. . |

*Primary Examiner*—Edgar S. Burr
*Assistant Examiner*—Lynn D. Hendrickson
*Attorney, Agent, or Firm*—Griffin, Butler, Whisenhunt & Kurtossy

[57] ABSTRACT

In order to be able to produce smaller units whenever needed from a keyboard that consists of an integral multiple key-guiding arrangement (3), a gummous mat (4) with resetting domes for keys (1) and a contact level (8), structural features are disclosed which particularly simplify a division of the multiple key-guiding arrangement (3). The structural features are such that the multiple key-guiding arrangement is divided into segments and the segments are interconnected with one another by connecting bars (17), and the connecting bars (17) can be divided by means of tools.

8 Claims, 5 Drawing Sheets

KEYBOARD

BACKGROUND OF THE INVENTION

The invention relates to a keyboard comprising a plurality of guidance components in each of which a key is movably mounted, with the guidance components being segments of an integral multiple key-guiding arrangement with a gummous mat that forms domes, e.g. for resetting pressed keys, and with a contact level which carries conductor tracks and contact arrangements, each switchable by one particular key.

Keyboards of this kind are known. They are characterized by having functional elements required for a single key position—multiplied in the form of levels, or layers—being available for several or all key positions. Such levels are easy to handle and eventually lead to inexpensive keyboards. Design and arrangement of the individual keyboard levels can vary. It is known, for instance, to further equip the domes of the gummous mat with electrically conductive surfaces for switching purposes (EP-A-0 453 274). The contact level can consist of a foil covered with electrically conductive surfaces, with a carrier level for mechanical stabilization located under the foil, if necessary. Printed boards with etched-out conductive surfaces, for example, are also known for use as contact levels (EP-A-0 3.98 186). Document EP-A-0 305 931 shows a multiple key-guiding arrangement with an integral keyboard casing. Genuine foil keyboards consist of a contact level and a closed keying level; operating keys and the necessary guidance and resetting elements are not part of foil keyboards.

In the case of the kind of keyboards described in the introductory paragraph, a number and distribution of the positions of the keys are determined by a tool used in manufacturing. This is true in particular with regard to the complex design of a multiple key guidance system. Dimensional changes in a field of keys, resulting from key positions, which in their entirety are desired after completion, require major work efforts and can sometimes only be carried out efficiently by using a new tool. In small-batch production both possibilities are inefficient.

Solutions are known which allow for any modification desired or for a limited modification of a field of keys. In EP-A-0 094 839, for example, there is a suggestion to create a desired field of keys by arranging individual key-guiding arrangements or small groups of key-guiding arrangements next to each other on any side. The key-guiding strips known from EP-A-0 087 369 and the strip-type tongues of the readjusting springs allow for a line-by-line extension of the field of keys. Such individual or grouped operational elements of a keyboard are difficult to handle.

SUMMARY OF THE INVENTION

It is an object of the invention to simplify the modification of a field of keys in the case of a type of keyboard mentioned in the introductory paragraph, so that small-batch production of a variety of keyboards can be carried out efficiently. The problem has been solved by providing a construction means for dividing a multiple key-guiding arrangement and/or for achieving this division by such a means, with the means consisting of two adjacent segments connected—across a dividing line—by one or several stable connecting bars which can be cut by a tool.

Apart from providing guided support of keys, a multiple key-guiding arrangement is also required to have sufficient stability to resist buckling or bending. For this reason, in the prior art the individual segments of a multiple key-guiding arrangement are, in general, connected seamlessly. After completion not even a tool can separate such segments cleanly and without further ado, which is in part due to an arrangement of holders for the support of a parallel guiding component for larger keys in an area next to an adjacent segment. Firstly, by way of the invention it is easy to separate the segments, for instance by punching or cutting using simple dies, and secondly, the desired mechanical stability is maintained by adequate proportioning of the connecting bars.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF PREFERRED EMBODIMENTS

Figure 1:
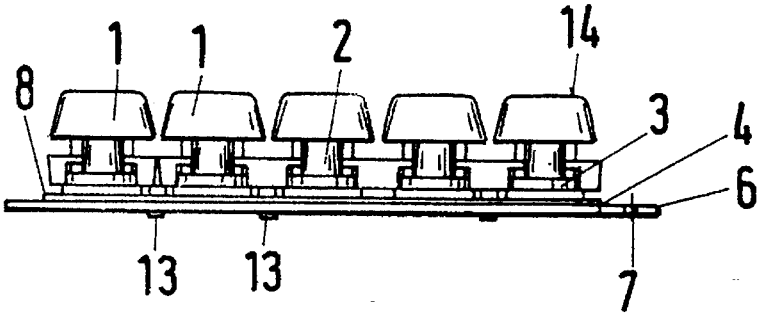
FIG. 1 shows a side-view of a keyboard according to the invention.
Figure 2:
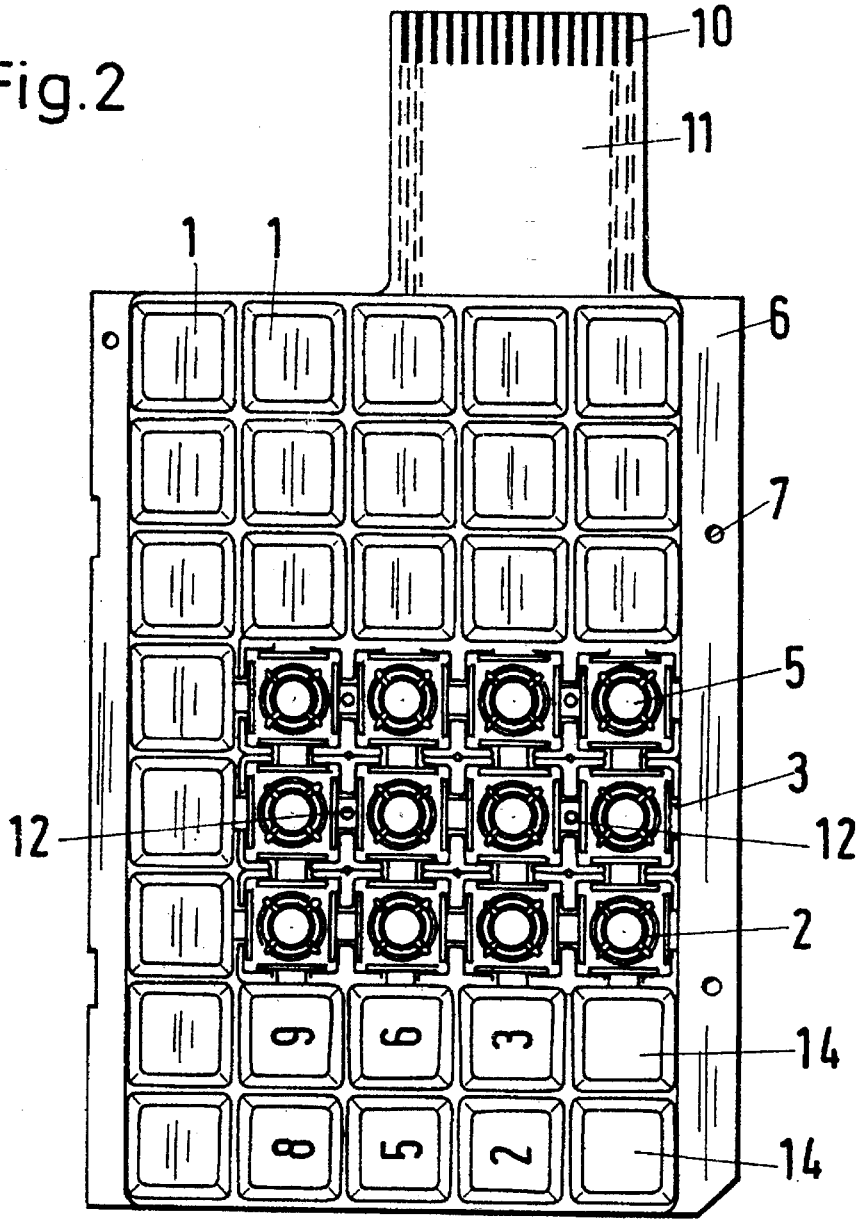
FIG. 2 shows a top view of the keyboard of FIG. 1 with some of the operating keys removed.

The invention relates to a keyboard comprising several levels (or relatively wide, flat elements), with each level carrying out a particular function which is available at every key position of the keyboard. A keyboard of this kind is shown in FIG. 1 and FIG. 2, respectively.

Figure 7:
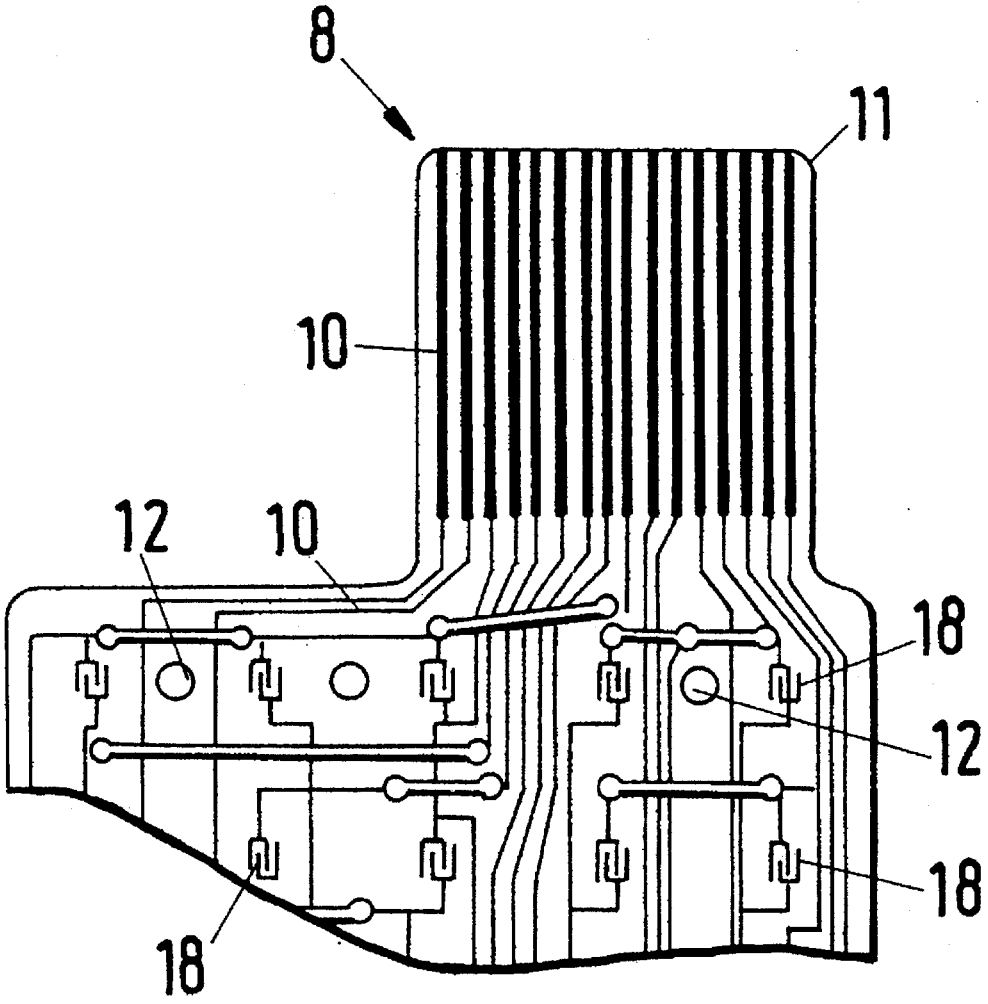
FIG. 7 shows a top view of a terminal portion of the contact level of the keyboard of FIGS. 1 and 2, respectively

All together, keys 1, which are arranged in a regular pattern, form a field of keys of the keyboard. Each key 1 is movably held by a guiding component 2. In their entirety the guiding components 2 form an integral multiple key-guiding arrangement 3 and each guiding component 2 represents a segment of the multiple key-guiding arrangement, or level, 3. The multiple key-guiding arrangement 3 rests on a gummous (rubber-like) mat 4. The mat 4 is made to form domes 5 each of which protrudes into a guiding component 2. By way of elasticity, domes 5 hold each of the keys 1 in its original position; that is, a key 1, operated by pressing, is set back into its original position by its respective dome 5. In addition, a supporting metal sheet 6 underneath the gummous mat 4 reinforces the keyboard to resist bending. By means of bores 7 in the supporting metal sheet 6, the keyboard is to be connected with a housing. Between the gummous mat 4 and the supporting metal sheet 6 an insulating foil with a conductive pattern printed on its upper side is added to form a contact level 8. The conductive pattern of the contact level 8 consists of contact surfaces, or elements, 18 and connecting lines 10 (FIG. 7). Contact surfaces 18 are assigned to keys 1 depending on their respective positions. Connecting lines 10 are led out via a tongue 11 of the contact level 8.

The various levels of the keyboard have bores 12 in true alignment into which pins, or pegs, 13 are inserted to hold the keyboards together. On their operating, or manipulating, surfaces 14, keys 1 have symbols explaining the respective functions which are triggered upon pressing the particular keys 1.

Figure 3:
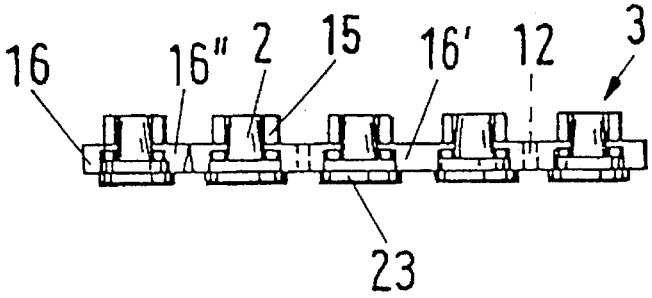
FIG. 3 shows a side view of a multiple key-guiding component of the keyboard of FIGS. 1 and 2, respectively.
Figure 4:
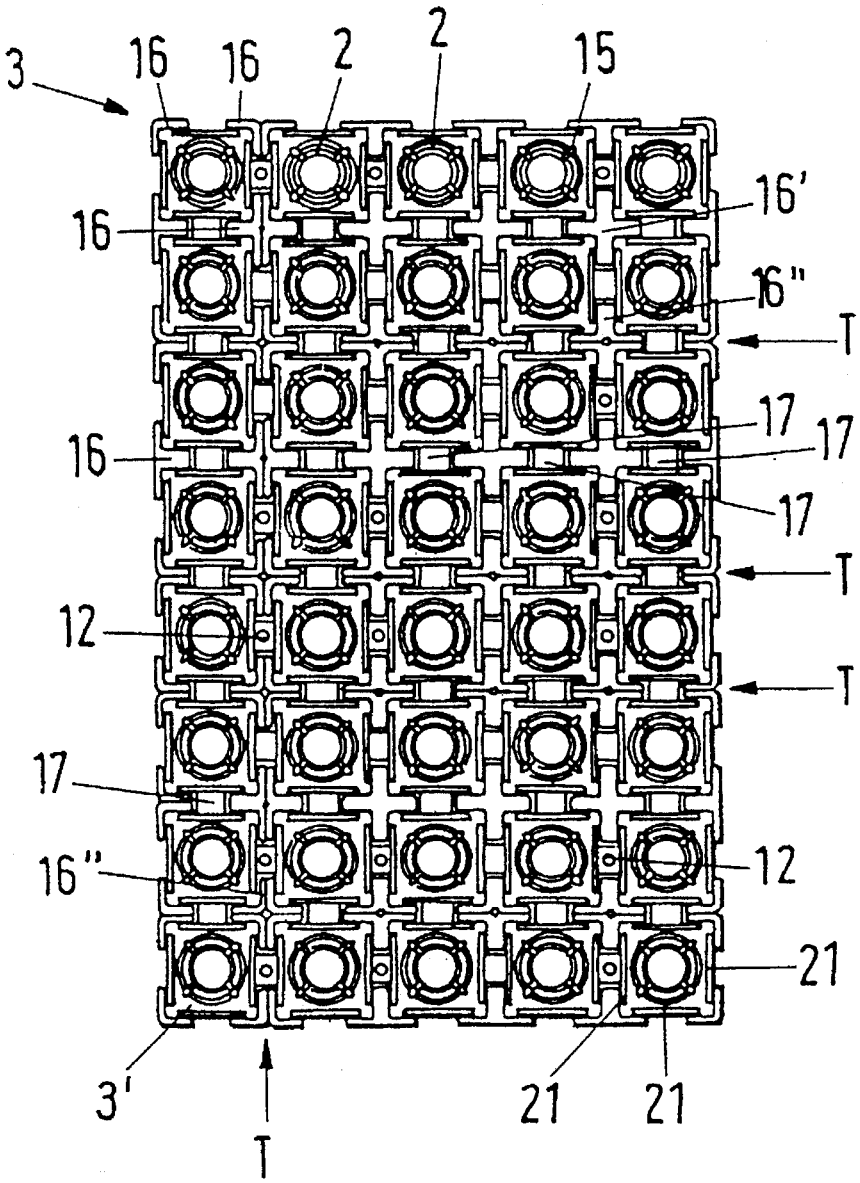
FIG. 4 shows a top view of the multiple key-guiding component of FIG. 3.

The multiple key-guiding arrangement 3 forms one level of the keyboard (FIG. 3, FIG. 4). Each segment 3' of the multiple key-guiding arrangement located in the pattern of keys 1 includes one of the guiding components 2 having guiding grooves 15 in which guiding components of the keys (not shown) engage for holding them between end positions. Each of the adjoining segments of the multiple key-guiding arrangement 3 are interconnected by a stable connecting bar 17. Connecting bars 17 have flat, or level, surfaces; they can easily be separated with the help of a simple tool by means of a die, either one after another or in groups. As this is possible, smaller units can be produced, when needed, from a more complex multiple key-guiding arrangement 3 without much effort. Particularly along predetermined dividing (or separation) lines, the multiple key-guiding arrangement 3 can be easily divided. The dividing lines at extensions of arrows T favour the creation of preferred sizes of 4×4, 4×5, 6×5 or 8×4 keys, for example. The segments have about their peripheries, on all sides thereof, holders 16 to position a parallel guiding component. Such a parallel guiding component is disclosed in U.S. Pat. No. 4,902,862 to Oelsch et al. Particularly large keys, the operating surfaces of which cover several guiding components, require a parallel guiding component. Holders 16 for a parallel guiding component are located in the peripheral area of a segment, for reasons of space, at its border to an adjacent segment. In order to improve the stability of the multiple key-guiding arrangement created by means of connecting bars 17, the tangential holders 16' of adjacent segments are formed as one piece to thereby form additional structure for interconnecting adjacent segments. It is only along the predetermined dividing lines (arrow T) that the holders 16" are divided correspondingly.

Some connecting bars 17 have been provided with bores 12 which are used for connection with further levels of the keyboards. Instead of bores 12, pegs for welding the keyboards together could have been formed. Bores 12 are distributed over the area of the multiple key-guiding arrangement 3 in such a way that they can also be used for smaller units.

Figure 5:
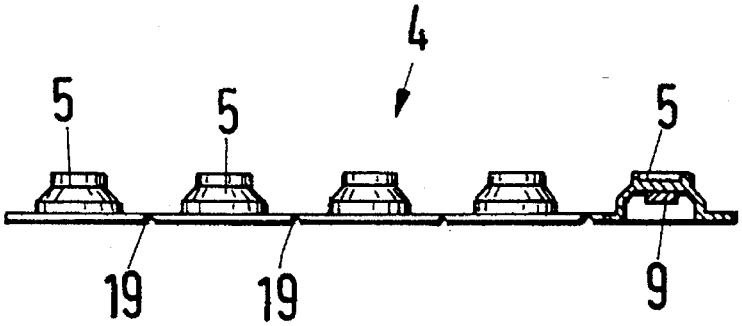
FIG. 5 shows a side view of a gummous mat of FIG. 1.
Figure 6:
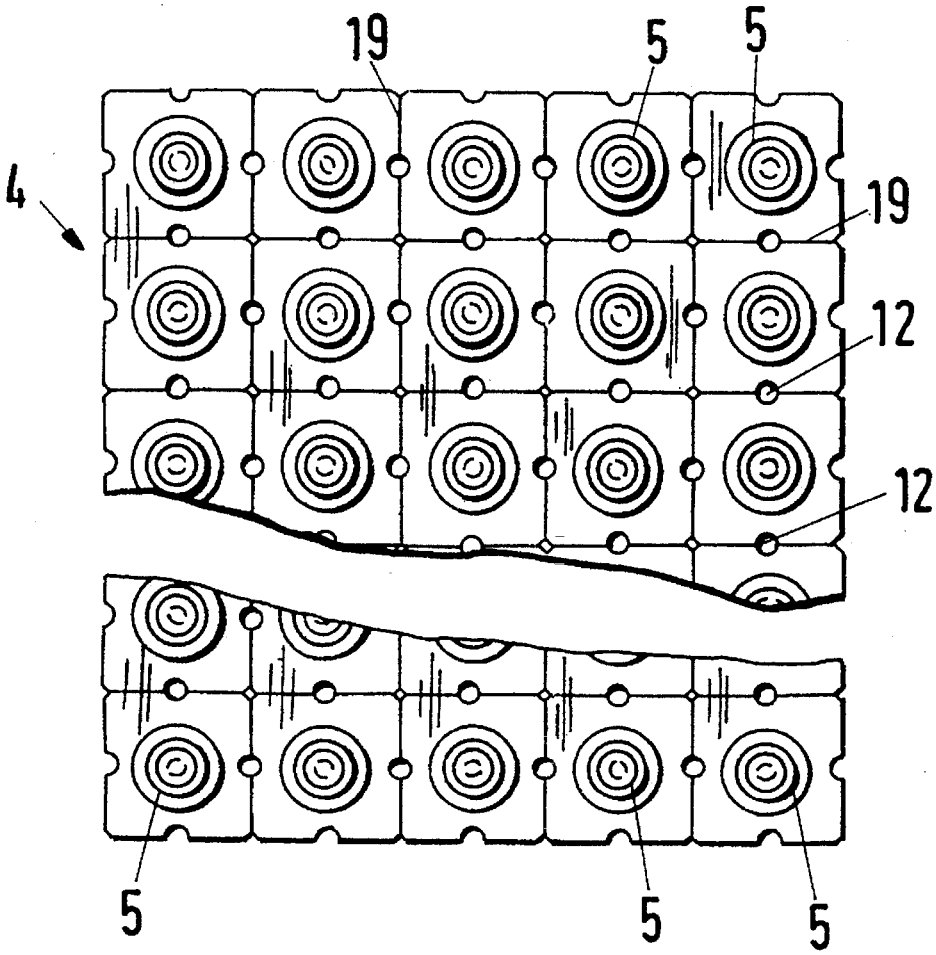
FIG. 6 shows a top view of the gummous mat of FIG. 5.

The gummous mat 4 forms domes 5 (FIG. 5, FIG. 6). Domes 5 are also located in the pattern of the keys 1. Domes 5 constitute spring elements for elastic resetting of pressed keys into their inoperative positions. Domes 5 are electrically conductive on their inner surfaces 9. The inner surface 9 is pressed against its respective contact surface 18 of the contact level 8 and triggers a switching process by means of short circuiting electrodes in the contact surface. The level containing the gummous mat 4 with the dome-like resetting elements can easily be divided at notched dividing lines 19 manually, if required, and can thus be adjusted to smaller units of multiple key-guiding arrangements without any problems. The bores 12 of the gummous mat 4 correspond to the bores 12 of the multiple key-guiding arrangement 3; they are also used for assembling the keyboard.

FIG. 7 shows a section of the contact level 8 with contact surfaces 18 and connecting lines 10 which are led to the tongue 11. The contact surfaces 18 are aligned with keys 1. The contact level 1 itself consists of an insulating foil which, on one side, has a conductive pattern applied in several layers. Insulating layers separate connecting lines crossing each other. A contact level made of insulating foil is easy to dimension mechanically by means of a knife or by scissors. The connecting lines 10 and the contact surfaces 18 are to be adjusted to the conditions of a smaller, new keyboard and thus have to be produced separately each time; a division of finished contact levels would sever some connecting lines and electrically insulate the corresponding contact surfaces. The supporting metal sheet cover 6, which supports the contact level, is not explicitly shown.

Figure 8:
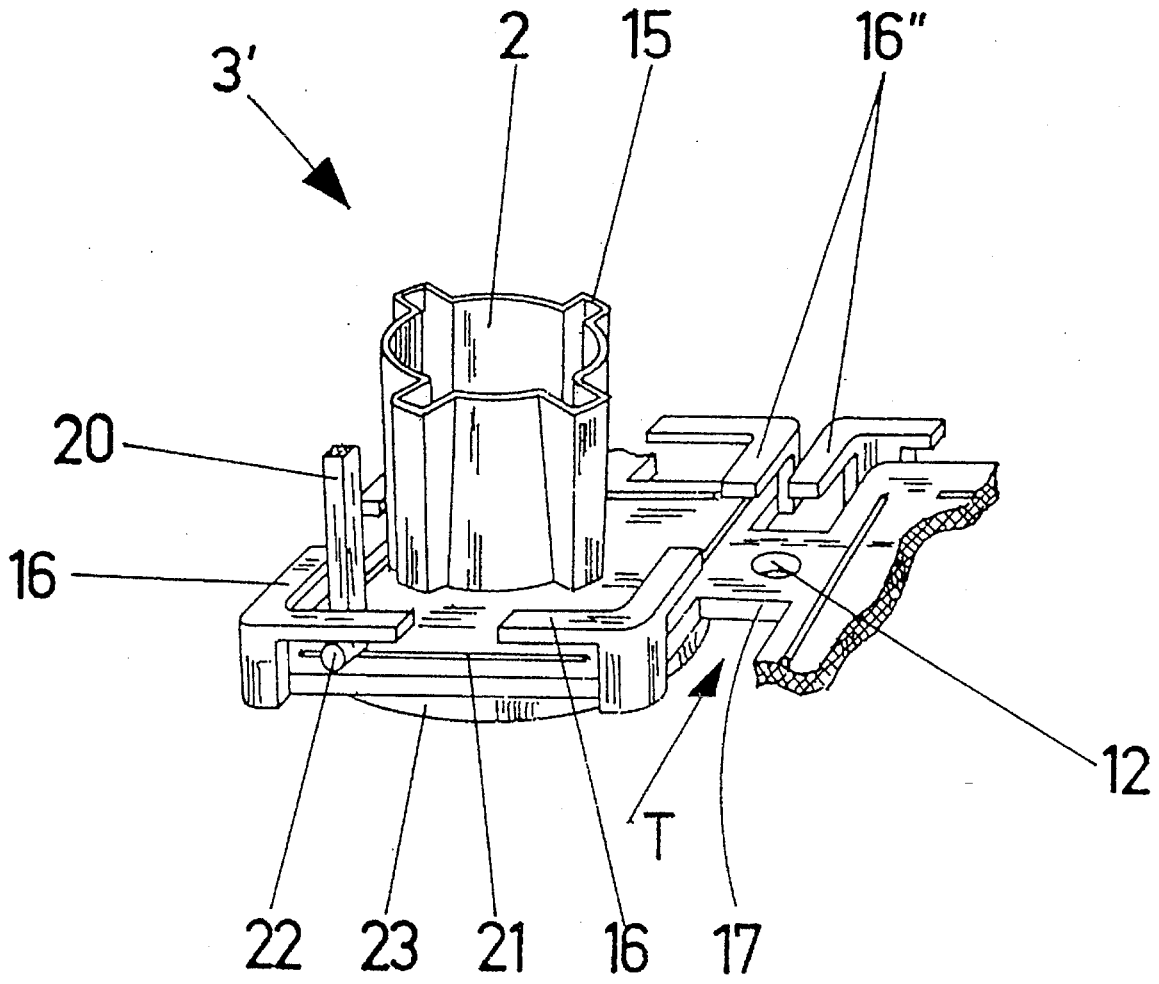
FIG. 8 shows an enlarged perspective view of a segment of the multiple key-guiding components of FIG. 4.

FIG. 8 depicts an individual segment 3' of the multiple key-guiding arrangement 3. In the center of the segment is the substantially pipe-shaped guiding component 2. The guiding component 2 has the duty of holding a key 1 mounted therein to be slidable along a length axis thereof. The guiding grooves 15 are formed along the guiding component 2. The guiding grooves 15, which cooperate with guiding elements (not shown) of the key 1, hold the key 1 mounted therein from rotation. A middle opening of the guiding component 2 serves to receive the key 1 as it passes through the segment. The opening enlarges at an underside of the segment 3' in an extension 23 of the guiding component 2. The dome 5 of the gummous mat 4 extends upwardly into the extension 23 and engages a lower end of the key 1 placed therein of a mounted keyboard. At an edge area of the segment, where it is seamed, or attached, to an adjacent segment, all-side holders 16, 16" for pins 22 of a parallel-guiding member 20 are formed. A distribution of the holders 16, 16' provides pivotal mounts in 90° steps for parallel-guiding members of keys. This is necessary, for example, in connection with cash registers. Along a predetermined separation line of the multiple key-guiding arrangement 3, extending along an arrow T, the holders 16" of adjacent segments are separately formed opposite one another; otherwise, the holders 16' (see FIGS. 3 and 4), in order to achieve greater stability, can be fabricated to cling together. The pins 22 are held in slits in the holders 16 so that they can slide laterally. The pins slide as soon as a guided key is moved. In order to improve the sliding of the pins 22, raised tracks 21 are formed on the surface of the segment on which the pins 22 lie. Unevennesses of the segment or dust on the segment surface cannot therefore obstruct the sliding capability of the pins. The connecting bar 17 connects the segment 3' with the adjacent segment. The connecting bar 17 has the bore 12 therein in which pins, or pegs, can be placed to hold a completely mounted keyboard together. In a combined form of the individual segments, all of the segments and the connecting bars 17 are formed together as a one piece multiple key-guiding arrangement 3, which can be molded as one piece.

For the assemblage of a keyboard the level of the multiple key-guiding arrangement 3, the level of mat 4 containing the resetting elements, the contact level 8 and the supporting metal sheet 6 functioning as a supporting level are put on top of one another in true alignment and are held together at the bores 12, for example by means of welded pins 13. After insertion of keys 1 into the guiding components 2 of the multiple key-guiding arrangement 3, the keyboard is complete. If a smaller unit of the keyboard is desired, dividing tools—if any—are required for the corresponding dimensioning of the levels; there is no need for new form tools for multiple key-guiding arrangements.

While the invention has been particularly shown and described with reference to a preferred embodiment thereof, it will be understood by those skilled in the art that various changes in form and detail may be made therein without departing from the spirit and scope of the invention.

The embodiments of the invention in which an exclusive property or privilege are claimed or defined are as follows:

1. A Keyboard having a plurality of guiding component segments each of which supports a key for sliding movement, with the guiding component segments being joined together to form an integral multiple key-guiding arrangement, said keyboard further having a gummous mat forming domes for contacting and thereby resetting pressed keys guided by said guiding component segments, and a contact level having electrical contact arrangements which are switchable by movement of said keys and their respective domes, wherein:

said integral multiple key-guiding arrangement further comprises connecting means for interconnecting the guiding component segments of the integral multiple key-guiding arrangement and for allowing said multiple key-guiding arrangement to be disconnected at dividing lines between the guiding component segments, said connecting means comprising a plurality of separated connecting bars for interconnecting adjacent guiding component segments and for being cut by a cutting tool for relatively easily disconnecting said adjacent guiding component segments at said dividing lines wherein some of said guiding component segments are interconnected with some adjacent guiding component segments only by said separated connecting bars at said dividing lines but are interconnected to other adjacent guiding component segments by said separated connecting bars and additional structure, whereby it is easy to disconnect guiding component segments at said dividing lines where they are interconnected only by said connecting bars by cutting said separated connecting bars but it is difficult to disconnect said adjacent guiding component segments where they are interconnected by said separated connecting bars and said additional structure.

2. A keyboard according to claim 1 wherein some of said separated connecting bars define bores for receiving pegs for assembling the keyboard.

3. A keyboard according to claim 1 wherein the gummous mat has adjacent segments corresponding to said segments of said guiding components and said gummous mat is notched between all adjacent segments.

4. A keyboard according to claim 1 wherein the guiding component segments comprise holders for parallel guiding components, with some holders of adjacent segments being attached to one another to form said additional structure and other holders of adjacent segments not being attached to one another at said dividing lines.

5. A keyboard according to claim 4 wherein some of said separated connecting bars define bores for receiving pegs for assembling the keyboard.

6. A keyboard according to claim 4 wherein the gummous mat has adjacent mat segments corresponding to segments of said guiding component and said gummous mat is notched between said adjacent mat segments.

7. A keyboard according to claim 1 wherein the gummous mat has adjacent mat segments corresponding to segments of said guiding component and said gummous mat is notched between said adjacent mat segments.

8. A keyboard according to claim 1 wherein said separated connecting bars are substantially flat and are bounded on side edges thereof by spaces.

* * * * *